United States Patent [19]

Parnell

[11] 4,156,525

[45] May 29, 1979

[54] RACKET STRINGING APPARATUS

[76] Inventor: Paul E. Parnell, 3215 Boundary St., San Diego, Calif. 92104

[21] Appl. No.: 839,036

[22] Filed: Oct. 3, 1977

[51] Int. Cl.[2] ..... A63B 51/14

[52] U.S. Cl. ..... 273/73 A

[58] Field of Search ..... 273/73 A, 73 B, 136 R, 273/139, 141 R, 143-145; 254/173 B, 174; 81/126

[56] References Cited

U.S. PATENT DOCUMENTS

| | | | |
|---|---|---|---|
| 2,262,110 | 11/1941 | Mineck | 273/73 A X |
| 2,309,849 | 2/1943 | Kausal et al. | 273/73 A |
| 3,302,950 | 2/1967 | Hartman | 273/73 A |
| 3,441,275 | 4/1969 | Held | 273/73 A |
| 3,635,080 | 1/1972 | Krueger et al. | 273/73 A X |
| 3,913,912 | 10/1975 | Smith | 273/73 A |
| 3,918,713 | 11/1975 | Kaminstein | 273/73 A |
| 3,988,022 | 10/1976 | Halbrook | 273/73 A |

FOREIGN PATENT DOCUMENTS

| | | | |
|---|---|---|---|
| 104900 | 8/1938 | Australia | 273/73 A |

*Primary Examiner*—Richard J. Apley
*Attorney, Agent, or Firm*—Brown & Martin

[57] ABSTRACT

A racket stringing apparatus includes a racket support frame rotatably mounted about a vertical axis on a suitable support base and including head and handle clamps for clamping the racket in the apparatus; an automatic tensioning head including an extensible arm having an automatic string head clamp mounted thereon, for extending outward from the support frame for applying a continuous preselected tension to a string attached thereto by the clamp; a cross slide platform mounted centrally of the support frame and between the racket clamps and including string holding clamps mounted on a slidable cross bar mounted on the cross slide platform, the cross slide platform being indexable to rotate about a vertical axis coincident with the vertical axis of the support frame. Power means for applying the continuous tension to the tension head includes, in one embodiment, a source of fluid pressure and a cylinder responsive to the pressure for applying a continuous preselected force on the string and valve controls including a valve responsive to the tension head clamp for activating the cylinder. An alternate embodiment includes weights of a preselected mass connected to the tensioning arm through a cable and pulley arrangement for applying a continuous uniform outward pressure on the tension head.

28 Claims, 12 Drawing Figures

RACKET STRINGING APPARATUS

BACKGROUND OF THE INVENTION

The present invention relates to racket stringing apparatus and pertains particularly to an improved apparatus having automatic uniform tensioning means.

The stringing of tennis rackets and the like is a time consuming process requiring extremely accurate tensioning of the strings in order to suit the racket to the individual player. Many types of machines and apparatus for stringing of rackets is known in the art. One successful type, however, is that shown in U.S. Pat. No. 3,441,275, issued Apr. 29, 1969. This apparatus, while satisfactory in many respects, does have a number of drawbacks. These and other prior art devices fail to maintain the proper tension under certain circumstances. For example, when cross stringing between strings already in position, the string can be pulled with sufficient tension; yet due to friction between the strings, may be slightly curved. When the curve is taken out of the string, slack in the string automatically results, which is not then compensated by the tensioning device.

Another problem with the prior art devices is that the clamping means frequently permits slack to result in the strings. This is due in part to the construction of the string holding clamps which are such that any wear results in permitting the clamp to either tilt or slightly move when tension is applied thereto resulting in a loss of the optimum tension in the string.

Still other problems include the difficulty of locating and manipulating the string holding clamps during the stringing operation. Such prior art construction provide for several different mounting positions of clamps for holding the strings. However, this requires multiple clamps and/or multiple mounting means for the clamps.

A further problem with prior art devices is the tension head clamp is complicated and expensive to construct and inconvenient to operate.

Still further problems of the prior art devices include the inability of the tension apparatus to maintain a predetermined continuous tension in the string, regardless of any slack that may be imposed thereon. Such devices are also complicated and difficult to operate and maintain.

Accordingly it is desirable that an improved racket stringing mechanism be available which has improved tensioning apparatus for applying and maintaining a predetermined tension on the strings and automatically taking up any slack that may develop therein and having improved clamping means which is simple and easy to operate and avoids the problems of slack as in the prior art.

SUMMARY AND OBJECTS OF THE INVENTION

It is accordingly the primary object of the present invention to overcome the above problems of the prior art.

Another object of the present invention is to provide an improved racket stringing apparatus having improved tensioning means for applying and maintaining a predetermined tension on the strings.

Still another object of the present invention is to provide an improved racket stringing apparatus having improved clamping means for clamping and maintaining tension in the strings during the stringing operation.

A further object of the present invention is to provide a racket stringing apparatus that is simple and convenient and easy to operate.

A still further object of the present invention is to provide an improved racket stringing apparatus having automatic tensioning means which is automatically responsive to engagement of the tension head clamp for automatically applying and maintaining a preselected tension on the strings.

In accordance with the primary aspect of the present invention, an improved racket stringing apparatus includes a racket mounting frame operatively associated with a tension applying means which is automatically operative in response to engagement of a string by the tension head clamp for applying and maintaining a preselected, uniform tension in the strings, and improved string clamping means for easily and quickly grasping and holding the strings under tension.

BRIEF DESCRIPTION OF THE DRAWING

The above and other objects and advantages of the present invention will become apparent from the following description when read in conjunction with the drawings, wherein.

DETAILED DESCRIPTION OF A PREFERRED EMBODIMENT

Figure 1:
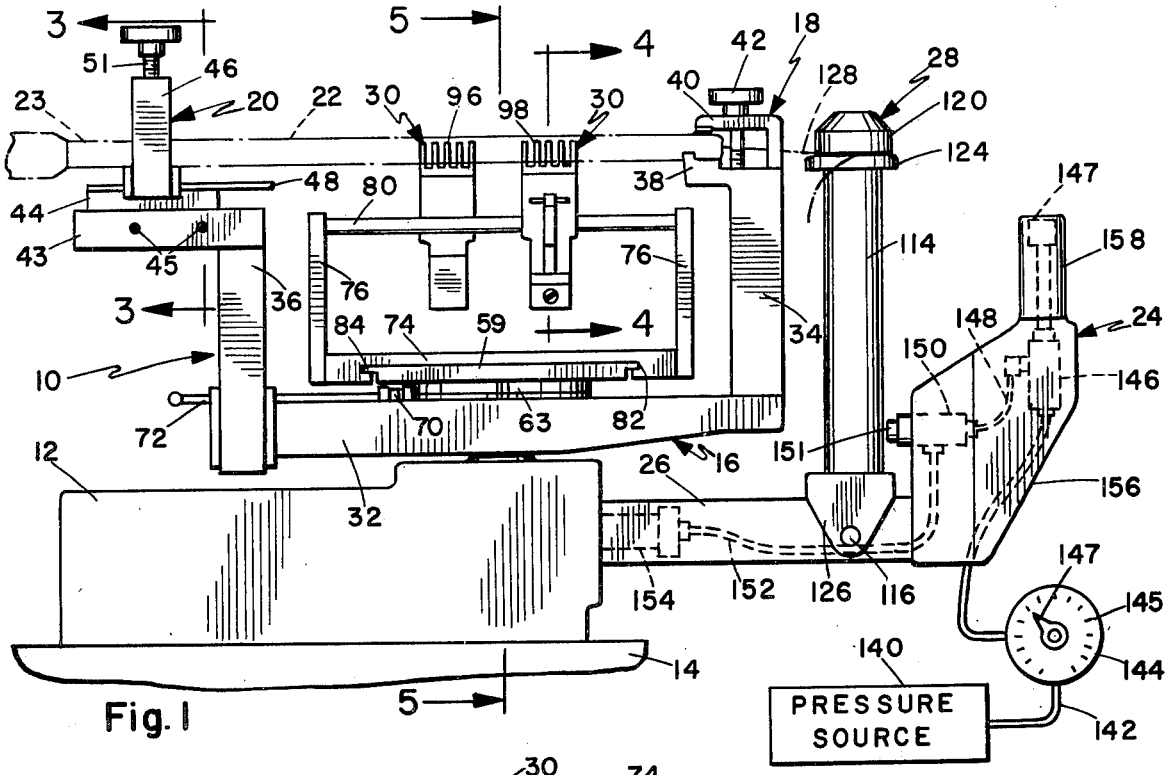
FIG. 1 is a side elevation view of the preferred embodiment of the apparatus.
Figure 2:
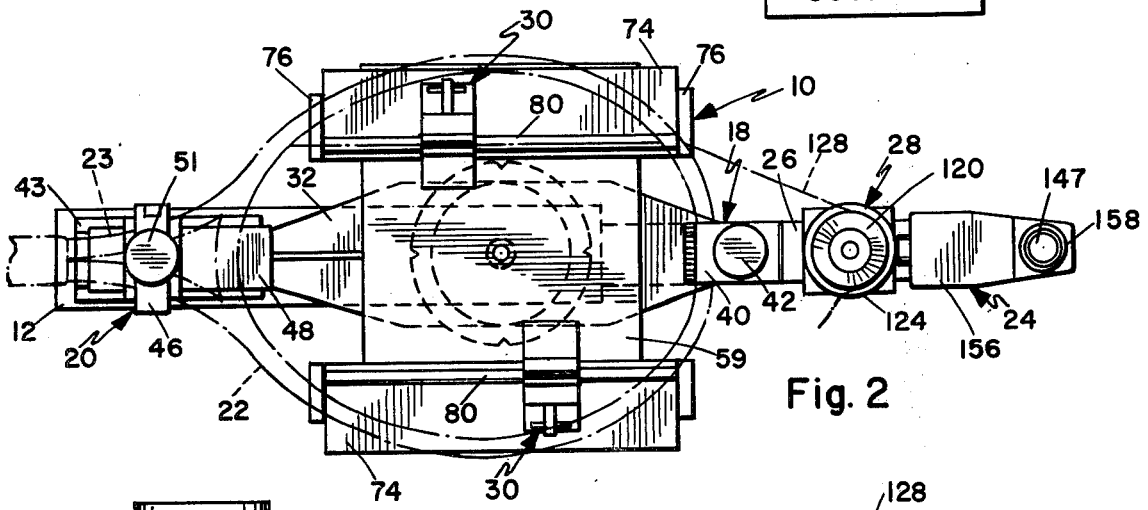
FIG. 2 is a top plan view of the apparatus of FIG. 1.

Turning now to the drawings, and particularly to FIGS. 1 and 2, there is illustrated a racket stringing apparatus in accordance with the present invention, designated generally by the numeral 10 and comprising a base housing or support member 12 supported in a suitable fashion at a convenient height, such as on a table or stand 14. The stringing apparatus includes a racket support frame designated generally by the numeral 16, which is preferably mounted for rotation about a vertical axis on the base housing 12. The support frame or table 16 is adapted to mount and support a tennis racket or the like between a pair of clamps such as a frame or head clamp 18 and a handle clamp 20. A tennis racket or the like 22 is supported, as illustrated in phantom in FIGS. 1 and 2, between the two clamps 18 and 20. A tension head assembly designated generally by the numeral 24 includes an extensible beam 26 extending outward from the base 12, and a string tensioning clamp designated generally by the numeral 28 for applying tension to the string while stringing the racket. The tension in the string is held by one or more string clamps designated generally by the numeral 30.

The general components of the system as above described cooperate to mount and generally position a racket and apply and maintain tension in the string during the stringing operation. In general the tension in the string is applied by the movement of the tension head assembly 24 and clamp 28 outward away from the base member 12 by extension of the beam 26. The tension in the string is then held by the one or more clamps 30 as the tension head clamp 28 is released and the string extended back through the frame and tension again applied to the string. The support frame 16 is generally freely rotatable about its vertical rotatable axis to permit ready alignment of the string with the tension head.

Racket Support Frame

The racket support frame or table 16 comprises a generally horizontally extending beam 32 rotatably mounted at its center to the base member 12 and including a first or head clamp post 34 at one end and a second or handle clamp post 36 extending vertically from the opposite end thereof. The head or frame clamp 18 is mounted on the upper end of clamp post 34 and includes a fixed jaw 38 and a moveable jaw 40 biased by a suitable screw member 42 into or toward the fixed jaw 38 for clamping the frame of a racket 22 therebetween.

Figure 3:
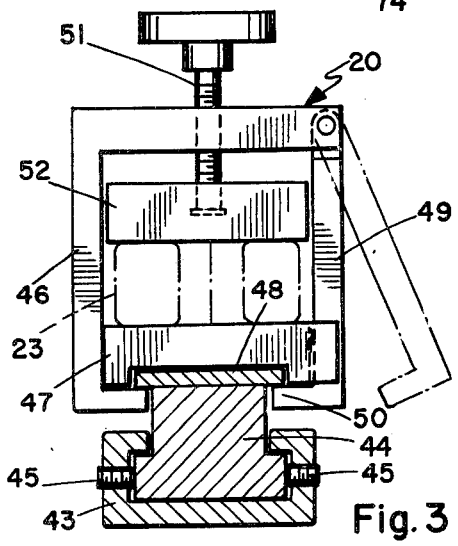
FIG. 3 is an enlarged sectional view taken on line 3—3 of FIG. 1.

The handle clamp 20 is mounted on the upper end of the handle clamp post 36 and includes, as best seen in FIG. 3, a horizontally extending support channel 43 extending outward from the upper end of the post 36, with a shoe 44 having a generally T configuration mounted within the channel and adjustably secured in place by means of set screws or the like 45. A frame 46 includes a pad block 47 engaging a guide bar or track member 48 and is slideably mounted thereon for adjustable positioning along the handle of the racket. The frame 46 includes an arm portion 49 pivotally secured thereto, with a hook portion 50 at the lower end thereof for hooking beneath the track member 48. A hand screw 51 is threadably mounted in the upper portion of the frame and includes a pad 52 for engaging the upper face of the racket handle. The pads 52 and 47 are preferably of a plastic material which can be slightly deformed in order to apply a sufficient pressure to retain the racket in place and yet not dent or otherwise deform the handle of the racket. The arm 49 swings out, as shown in phantom, to permit the racket handle 23 to be swung in and out of the clamp 20.

Figure 5:
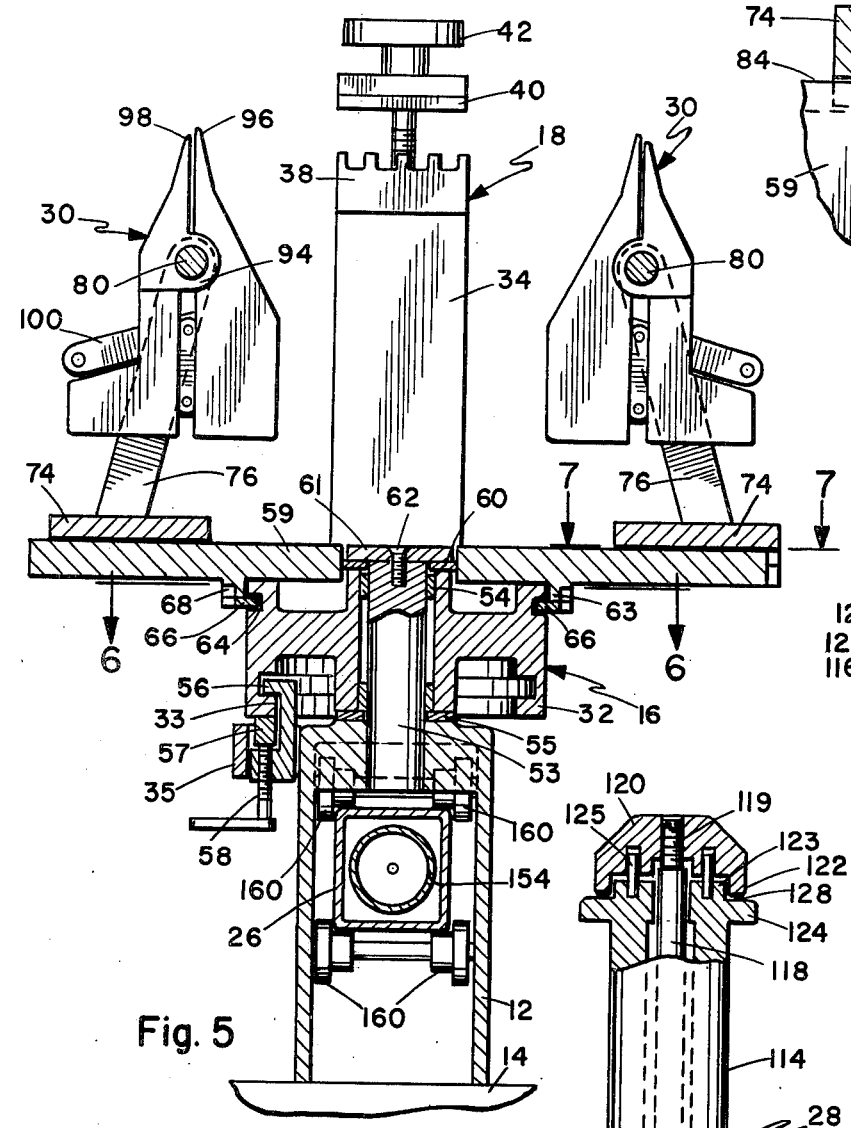
FIG. 5 is an enlarged sectional view taken on line 5—5 of FIG. 1.

The racket table or support frame, particularly beam portion 32, is rotatably supported, as best seen in FIG. 5, for rotation about a vertical axis on a shaft 53 which is fixed to the base housing 12. The beam 32 is journalled on the shaft 53 by suitable bearings 54 and supported on the housing 12 by a thrust bearing 55. The beam 32 is held in place by a retaining washer 61 secured to the upper end of shaft 53 by a screw 62, with a thrust bearing 60 between the shaft and the washer. Suitable brake means is provided, such as a clamp 56 having a friction pad 57 mounted on a screw 58 mounted in the clamp, which is held in a bracket 35 fixed to housing 12. The friction pad 57 engages the underside of an annular rim 33 on beam 32 for locking the table or support frame in selected angular positions about the shaft 53.

String Clamps

As best seen in FIG. 5, a cross slide platform 59 having a generally rectangular configuration, is rotatably mounted coaxially with the support table or frame 16 for rotation either relative thereto or rotation therewith. This cross slide platform has a hub portion 63 which fits over and is retained on an annular flange portion 64 of the beam 32 by means of a detachable retaining lug 66. The cross slide platform mounts and supports a pair of string clamps 30.

Figure 6:
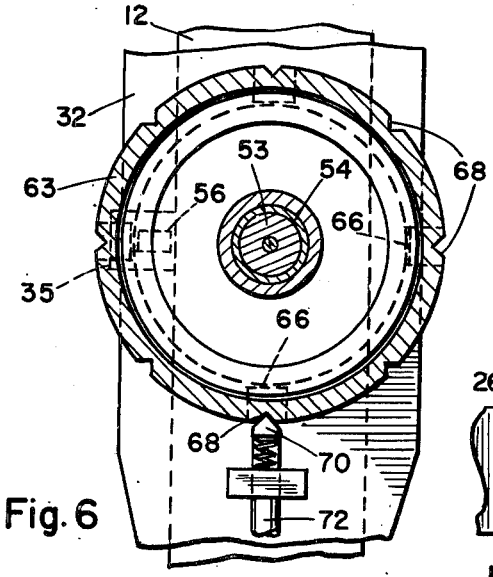
FIG. 6 is a sectional view taken on line 6—6 of FIG. 5.

Suitable indexing means for indexing the cross slide platform relative to the support table or frame 16 includes a plurality of indexing notches or detents 68, which are engaged by a locking pawl 70 mounted on the end of an indexing handle 72 as best seen in FIGS. 1 and 6. This indexing arrangement permits the cross slide platform and associated clamps 30 to be aligned with the respective strings in the racket frame. Additional detents are provided for indexing the platform to 45° angles to accommodate rackets having strings at this angle.

Each of the clamps 30 is mounted on a clamp support frame comprising a slide block or bar 74 having a pair of upwardly extending arms 76 extending upward from the slide block 74 at an angle thereto, with a support rod 80 extending between the upper ends of the support arms 76. The slide block 74, as best seen in FIG. 1, is shaped to define a pair of opposed grooves 82 for engaging flanges 84 along opposite edges of the cross slide platform 58, for holding the slide block on the cross slide platform 59.

Since the cross slide platform is indexable relative to the racket support frame 16, the platform can be rectangular in configuration because the slide blocks may be retained on a given edge of the platform without the necessity of changing or removing them and replacing them in the opposite orientation or 90° orientation. In addition the cross slide platform can be indexed to a 45° angle to accommodate rackets which have strings extending at a 45° angle. This arrangement also permits the use of longer slide platform as well as longer slide bars or rods for the clamps.

Figure 7:
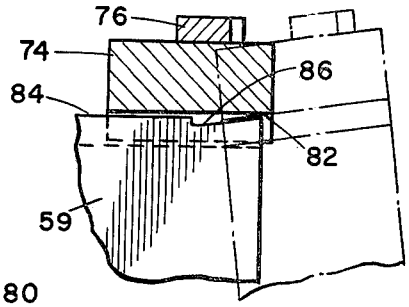
FIG. 7 is a sectional view taken on line 7—7 of FIG. 5.

An additional feature of the construction, as seen in FIG. 7, is the provision of an angled notch 86 at one corner on each end of the slide platform. This permits easy placement of the slide 74 on the table. One end of the slide is placed in the notch, as shown in phantom in FIG. 7, and then pivoted around with the other end engaged on the opposite corner, thereby providing easy placement of the slide on the table. This compensates for such a problem which is aggravated by the close and precise fitting of the slide to the slide platform. The depth of the notch is such as to permit the opposite side of the slide to easily clear the opposite corner of the platform.

Figure 4:
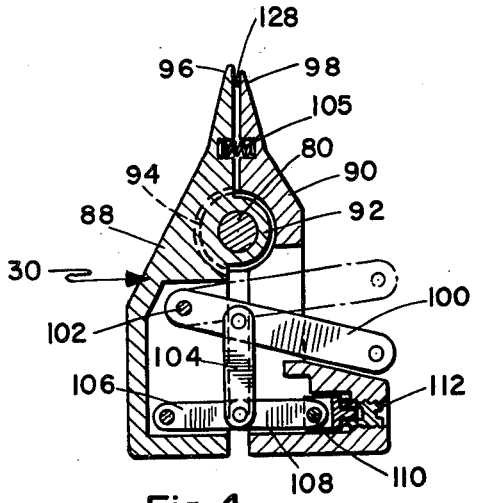
FIG. 4 is an enlarged sectional view taken on line 4—4 of FIG. 1.

The specific construction of the string clamps 30 is best illustrated in FIG. 4, with reference also to FIGS. 1 and 5. The string clamps each comprises a pair of clamp bars 88 and 90, each of which is pivotally mounted on the support rod 80. The bar 88 is provided with a central journal bracket 92, disposed between a pair of journal brackets 94 on the bar 90. These journal brackets have a cylindrical bore extending therethrough for tight fitting engagement with the cylindrical support rod 80. Each bar is formed at its upper end with slots which define a plurality of separate fingers 96 and 98 for the respective bars. It will be noted that the fingers 96 of bar 88 extends upward slightly beyond the fingers 98 of the bar 90. This facilitates engagement of the string with the jaws with appropriate dimensioning of the clamps and their support structure.

The two jaws of each of the clamps are clamped into clamping engagement by a toggle linkage arrangement, including a toggle arm 100 pivotally connected by a link 104 to the ends of the pair of links 106 and 108. These links 106 and 108 are pivotally connected at their opposite ends to separate ones of the bars 88 and 90. An adjustable pivot 110 for link 108 includes a screw 112 threadably engaging a bore in the bar 90. Movement of the pivot point 110 adjusts the opening of the jaw between the fingers 96 and 98. The toggle linkage is preferably arranged for a slight overcenter, locking of the links when in the closed position. It will be appreciated that the clamp can be adjusted for different openings of the jaws at fingers 96 and 98 for different size strings as well as different degrees of gripping. It will also be appreciated that the clamps upon gripping the string will also grip the bar 80 and will be retained in its longitudinal position. Biasing means such as a spring 105 biases the jaws of the clamp to the open position when the toggle means is released.

Sufficient fingers are provided such that in combination with the adjusting means, the clamp may be adjusted to apply adequate pressure for gripping the string without crushing it. The clamp may be slid along the rod 80 to grip the strings in selected positions along its length. Likewise the clamp support frame can be slid across the cross slide platform for properly positioning the clamp for each respective string. Similarly, a pair of the clamps may be utilized, as illustrated in FIGS. 1 and 2, for working each side of the center line of the racket frame. Additional clamps may be utilized if necessary.

Tension Head Clamp

Figure 10:
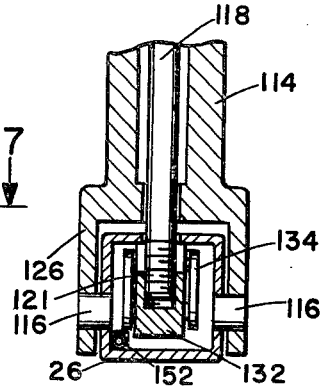
FIG. 10 is a sectional view taken on line 10—10 of FIG. 8.
Figure 8:
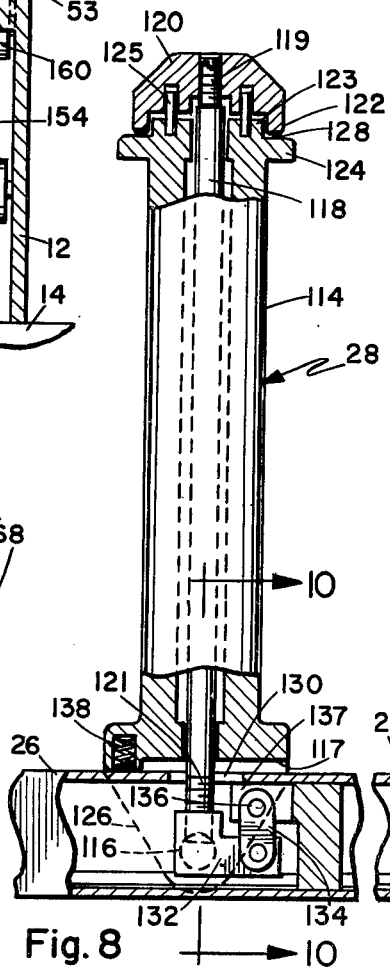
FIG. 8 is an enlarged side elevational view, partially cut away, of the tension applying clamp in the clamp position.
Figure 9:
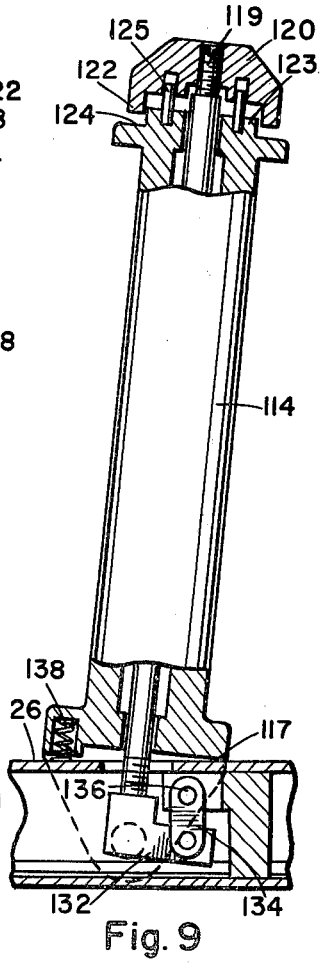
FIG. 9 is a similar view with the clamp in a released position.

The tension head clamp 28 for clamping the string to the tension head for applying tension thereto is best illustrated in FIGS. 8 through 10. The tension head clamp comprises an elongated, generally cylindrical upwardly extending post 114, pvitoally mounted at its lower end on the tension beam 26. The lower end of post 114 has a fork 126 which straddles tension beam 26 and is held by pivot pins 116. Post 114 can move between a vertical position relative to tension beam 26 and an inclined position tilted a few degrees toward the outer end of the beam. Fork 126 has an undercut portion providing a stop 117 to limit the inclination, as in FIG. 9. The post 114 is of a generally tubular configuration and has a clamping rod 118 extending upward coaxially thereof through the central bore, with a clamp head 120 secured to the upper end thereof such as by screw threads or the like 119. The clamp head 120 is of a generally circular configuration having an axially extending flange defining an annular gripping jaw 122, which cooperatively engages an opposing annular jaw 124 formed on the upper end of the clamping post 114. The clamping jaw or flange 124 extends outward a greater diameter than the outer diameter of the clamping head 120 for facilitating placement of the string in the clamp head. The upper end of post 114 has a hub 123 projecting above jaw 124. Annular jaw 122 fits over the hub 123 and the hub provides a stop around which the string 128 is wrapped. The annular jaws provide an extended gripping jaw which permits the clamping pressure to be applied over an extended length of the string such that considerable clamping force may be applied thereto without crushing the string. This is an important consideration in the stringing of rackets and the like.

The tension rod 118 extends through an opening 130 in the beam 26 and is pivotally mounted inside the beam 26 to pivot about a point offset from the pivot point 116 of the post 114. The pivot of the rod 118 is established by a connection of a shoe 132 at the lower end thereof pivotally connected by links 134 to a pivot pin 136 to a bracket 137 inside the beam 26. This offset relationship of the pivot points between the post 114 and tension rod 118 causes the clamping jaws 122 and 124 to move toward and away from each other upon pivotal movement of the clamp post 114 away from a vertical position relative to axis of the beam 26. Biasing means, such as a spring 138, biases the clamping assembly to the inclined and open position as shown in FIG. 9. Tension rod 118 has a threaded lower end 121 threaded into shoe 132 with threads of opposite pitch to those at 119. By turning the tension rod 118 from the upper end, it is thus possible to adjust the gap between jaws 122 and 124 and so control the clamping pressure. Pins 125 in the hub 123 prevent head 120 from rotating. It will be appreciated that when the clamp is in the open position as shown in FIG. 9, a string 128 may be pulled out from racket 22 and passed around the clamp head as shown in FIG. 2, slipped between the jaws 122 and 124 and wrapped around hub 123, then pulled taut (i.e. the end pulled toward the racket frame) for tilting the clamp head to the upright position as shown in FIGS. 1 and 8. In pulling the clamp to the upright position, the jaws 122 and 124 clamp onto the string holding it into position. Extension of the clamp head beam 28 outward, as will be described, applies tension to the string 128. When the tension on the string is relaxed, the clamp tilts as in FIG. 9, to open the jaws and release the string.

Tensioning Head

The tensioning head for applying tension to the string of the racket, broadly designated by the numeral 24, includes control means for controlling the application of tension to the string by applying a predetermined bias to the tensioning head clamp 28 in the proper direction to apply the desired tension to the string. This tension applying means as broadly disclosed in FIG. 1, comprises a course of pressurized fluid 140, which may be either hydraulic or compressed air, which is connected by a conduit 142 including suitable pressure regulator 144, to a control valve 146, conduit 148 to a second control valve 150, and by way of conduit 152 to a linear motor such as an air cylinder 154. In the illustrated embodiment, the source of pressure is compressed air, the pressure which is regulated by the pressure regulator 144, which preferably is graduated with a suitable dial 145 and has a control knob 147 for adjusting the pressure to correspond to the preselected tensions for the string. Preferably the dial 145 has a scale that is graduated such that the tension can be directly selected by the knob 147. This of course can essentially be predetermined by calculating the pressure acting on the cylinder within the air cylinder 154. The force applied is proportional to the piston area and fluid pressure acting on the piston.

The valves 146 and 150 are normally open. Valve 146, for example, includes a control button 149 which closes the valve, preventing communication from the source 140 and the conduit 148 and thence the line 148. The valve 150 similarly includes a control button or plunger 151 which also acts to close the valve and to vent the line 152 and likewise cylinder 154.

Accordingly, when the tension head clamp 28 is permitted to tilt to its open position as shown in FIG. 9, it engages the actuating plunger 151 of valve 150, closing the valve to the source of pressure and venting the air cylinder 154. However, upon pulling the clamp away from the actuator 150, as by the clamping of a string therein, the valve 150 immediately opens, communicating fluid pressure from the source 140 to the air cylinder 154 which acts to push beam 26 outward to its outermost position until the tension on the string 128 reaches the selected tension. It will be appreciated that with this arrangement a predetermined tension is selected by the regulator 144 and this tension is automatically applied to the string 128 as soon as the string is clamped in clamp 28. This tension is maintained on the string as long as the string is clamped within the clamp 28. In order to release the tension, button 147 is pressed downward, such as by the finger or thumb, thereby closing valve 146 and venting the line 148 and air cylinder 154. The tension head and beam may then by pushed to the left toward the table 12. The control valves are mounted within a valve housing 156 and include a handle or grip 158 at the upper end thereof for grasping and pushing the tension head assembly and beam 26 to the left for releasing the tension on string 128.

Figure 11:
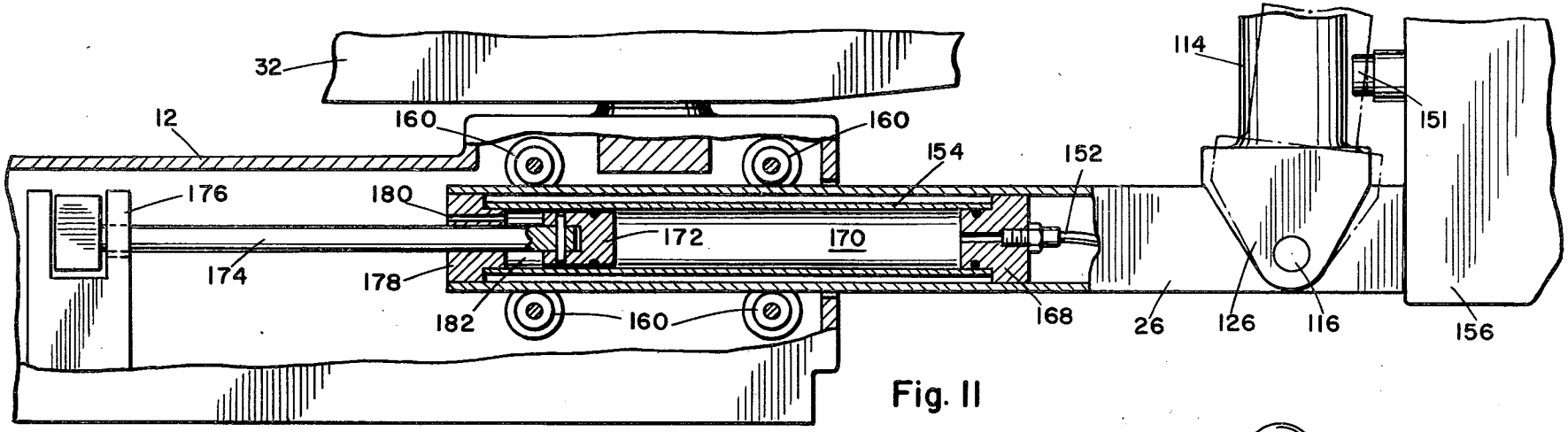
FIG. 11 is an enlarged side elevational view of the base portion of the apparatus cut away to show the tension applying mechanism.

As best seen in FIGS. 5 and 11, the beam 26 is of open beam construction of generally rectangular cross section and is mounted within the housing 12 between a plurality of pairs of spaced apart support rollers 160. The tension beam 26 is powered by air cylinder 154 as explained above. One end of the air cylinder has a head 168 through which fluid communicates from conduit 152 for communicating with a pressure chamber 170 of the cylinder. A piston 172 is reciprocally disposed within the cylinder 154 and is connected to a piston rod 174, which is connected at its other end in a suitable manner, such as by a bracket 176, to the housing 12. The other end of air cylinder 154 has a plug 178 having a vent opening 180 for venting the chamber 182. This arrangement can function as damping means for controlling the rate of movement of the beam 26. Thus with this arrangement the air pressure in cylinder 154, acting in chamber 170 on piston 172, acts to apply a continuous pressure on the tension head and thereby apply a continuous tension on the string attached thereto, such that it will pick up any slack developed in the string and maintain the selected tension on the string.

Figure 12:
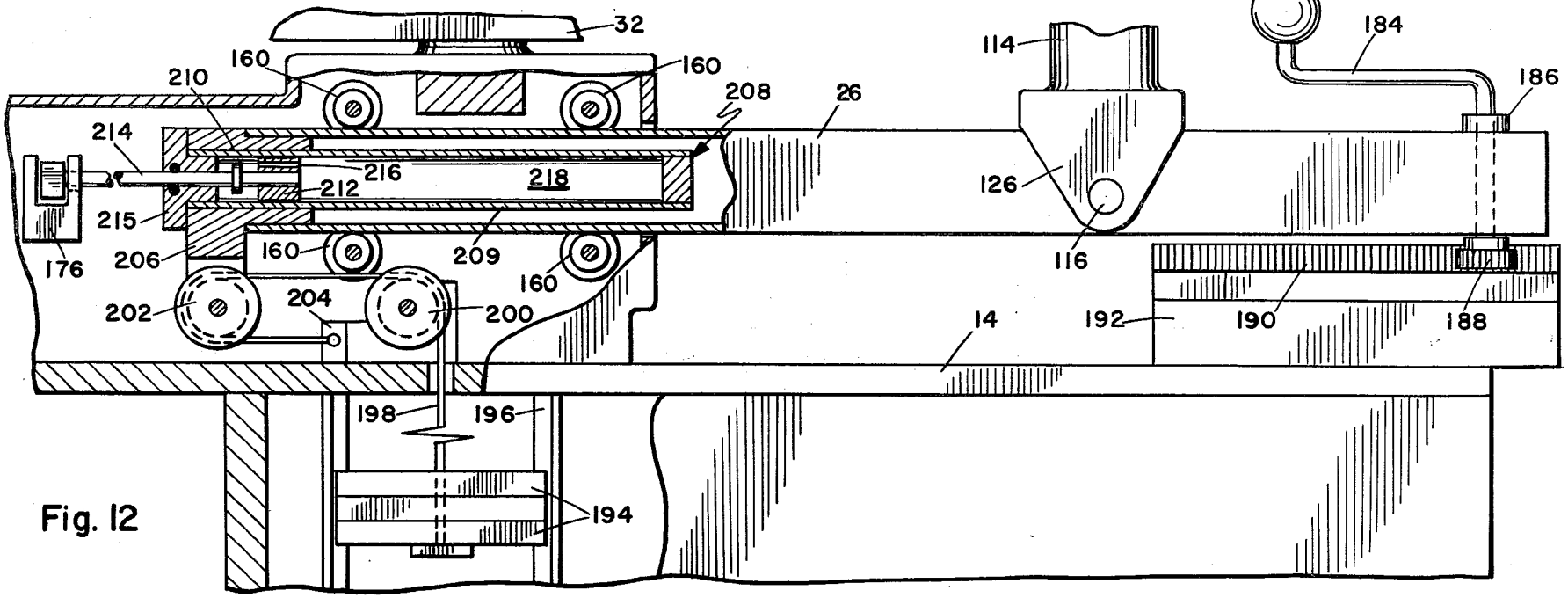
FIG. 12 is a similar side elevational view showing an alternative weight arrangement for applying tension.

The FIG. 12 embodiment also applies a continuous pressure but in a slightly different manner. In this embodiment, identical elements will be identified by the same reference numerals. The tension head beam 26 is modified to include a manual return mechanism comprising a hand crank 184 journaled in suitable bearings 186 in the beam, and including a pinion 188 for engaging a rack 190 secured by a bracket 192 to support table 14. With this arrangement the crank 184 may be cranked to relieve the tension of the tension head on the string and move the beam 26 to the left.

The tension applying mechanism of this embodiment for applying the force to beam 26 comprises a plurality of weights 194 supported on guide rails 196 in the base support housing or table 14. These weights are detachably secured to a cable 198 or the like, which is trained over a fixed pulley 200 mounted on the support table 14, and further over a pulley 202 which is mounted on the beam 26, and then to a fixed point where the end thereof is fastened to a bracket 204 on the table 14. The moveable pully 202 is mounted on a bracket 206 which is secured to the beam 26 at the inner end thereof and also holds a dash pot or other suitable damping means 208. This damping means is in the form of a cylinder 209 which extends into the beam 26 and is held in a bore 210 through bracket 206. A piston 212 is secured to a fixed piston rod 214 which is secured to bracket 176 and extends into cylinder 209 through an end cap 215. Piston 212 has a bleed orifice 216 which allows the fluid from chamber 218 of cylinder 209 to leak at a controlled rate. This dash pot acts in a known manner to dampen the rate of movement of the beam 26 under the action of the weights 194. The mass of the weights 194 is adjusted by selectively placing a suitable number of weights on the cable 198 to obtain the desired tension applied by the tension head to the string. Again, as in the previous embodiment, the tension head can apply a continuous constant force on the end of the string clamped in the clamp 28 and will automatically compensate for any slack in the string, take up the slack and continuously maintain the predetermined tension.

While the present invention has been described and illustrated by means of specific embodiments, it is to be understood that numerous changes and modifications may be made therein without departing from the spirit and scope of the invention as defined in the appended claims.

Having described my invention, I now claim:

1. A racket stringing apparatus comprising:

a base member, a frame support table mounted for rotation about a vertical axis on said base member and including first and second spaced apart racket clamping means for mounting a racket to be strung, a cross slide platform mounted between said clamping means on said frame support table for slidably mounting a plurality of string clamps, said cross slide platform including a pair of parallel guide edges defining a pair of parallel slide rails and at least a cross slide member mounted on said slide rails and including a support rod mounted on and spaced vertically from said cross slide member, a string clamp pivotally mounted on said support rod and including a pair of elongated clamping bars having means defining clamping jaws at one end and toggle link means at the other end thereof and said bars being pivotally mounted intermediate the ends thereof to said support rod, and a tensioning head mounted on and extending outward from said base and including tension head clamping means for gripping a string and continuous automatic tensioning means for automatically and continuously applying and maintaining a preselected tension in a string clamped in said tension head clamping means.

2. The stringing apparatus of claim 1, wherein said automatic tensioning means comprises fluid pressure means responsive to engagement by said tension head clamping means for continuously biasing said tension head outwardly away from said support table.

3. The stringing apparatus of claim 1, wherein said automatic tensioning means comprises a preselected mass connected for continuously biasing said tensioning head outwardly.

4. The stringing apparatus of claim 1, wherein said tensioning head comprises a elongated beam reciprocably mounted on said base member and reciprocable between innermost and outermost positions, and biasing means acting on said beam for biasing said beam to the outermost position.

5. The stringing apparatus of claim 4, wherein said biasing means comprises a fluid motor connected to said base member and said beam, a source of pressurized fluid, and control means responsive to clamping engagement by said tension head clamping means for communicating a source of pressurized fluid with said fluid motor for continuously biasing said beam outward to its outermost position.

6. The racket stringing apparatus of claim 1, wherein said clamp includes a toggle arm pivotally connected to one of said bars and extending outward therefrom, a pair of toggle links pinned together at one end and pivotally connected at their opposite ends to different ones of said clamping bars and a connecting link pivotally connected between said toggle arm and the pivotal connection of said toggle links together.

7. The racket stringing apparatus of claim 6, wherein the pivotal connection of one of said toggle links to one of said bars is adjustable for thereby adjusting the opening of the jaws of said clamp.

8. The racket stringing apparatus of claim 7, wherein said toggle arm is pivotally connected to one of said bars and extends through a slot in the other of said bars outward beyond the other of said bars.

9. The racket stringing apparatus of claim 1, wherein said cross slide platform includes a notch in one of said parallel edges adjacent the edge one end thereof for ease of placement of said cross slide member on said cross slide platform.

10. The racket stringing apparatus of claim 1, wherein said cross slide platform is rotatably mounted co-axially with said frame support table for relative angular movement with respect thereto, and indexing means for selectively indexing of said cross slide platform with respect to said frame support table.

11. A racket stringing apparatus comprising:

a base member, a frame support table mounted for rotation about a vertical axis on said base member and including first and second spaced apart racket clamping means for mounting a racket to be strung, a cross slide platform mounted between said clamping means on said frame support table for slidably mounting a plurality of string clamps, a tensioning head including an elongated beam reciprocably mounted on and extending outward from said base and tension head clamping means comprising an elongated member pivotally connected at one end to said beam and extending upward therefrom, a pair of opposed annular gripping jaws at the upper end of said elongated member, and said jaws responsive to pivotal movement of said elongated member for gripping a string between said annular jaws, biasing means comprising a fluid motor connected to said base member and said beam, a source of pressurized fluid, and control means responsive to clamping engagement by said tension head clamping means for communicating a source of pressurized fluid with said fluid motor for continuously biasing said beam outward from an innermost position toward an outermost position for continuously applying and maintaining a preselected tension in a string clamped in said tension head clamping means.

12. The racket stringing apparatus of claim 11, wherein said control means includes a valve mounted adjacent to said elongated member and engageably by said elongated member during pivotal movement thereof when pivoted to the disengaged position for disabling said fluid motor.

13. The racket stringing apparatus of claim 12, wherein said elongated member pivots away from said valve member out of engagement thereof during tensioning of said string in said clamp and further tensions said string by opening said valve and communicating fluid pressure to said fluid motor.

14. A racket stringing apparatus comprising:

a base member, a frame support table mounted for rotation about a vertical axis on said base member and including first and second spaced apart racket clamping means for mounting a racket to be strung, a cross slide platform mounted between said clamping means on said frame support table for slidably mounting a plurality of string clamps, a tensioning head including an elongated beam reciprocably mounted on and extending outward from said base and including tension head clamping means for gripping a string, biasing means comprising a fluid motor connected to said base member and said beam, a source of pressurized fluid, and control means responsive to clamping engagement by said tension head clamping means for communicating a source of pressurized fluid with said fluid motor for continuously biasing said beam outward to its outermost position for automatically and continuously applying and maintaining a preselected tension in a string clamped in said tension head clamping means, control means comprising first and second normally open valve means normally biased to an open position for open communication of fluid from said pressurized fluid to said fluid motor, and said tension head clamping means is pivotally mounted on said beam and including biasing means for biasing said tension head clamping means to an open position, said tension head clamping means normally biased into engagement with one of said first and second valve means for biasing said one of said valve means to a closed position for diabling said fluid motor.

15. The stringing apparatus of claim 14, wherein said tension head clamping means comprises first and second elongated clamping members pivotally connected to said beam and extending co-axially outward therefrom and including annular clamping means at the outer end thereof.

16. The stringing apparatus of claim 15, wherein said clamping means includes an outer tubular member pivotally connected to said beam at one end thereof and having an annular jaw at the other end thereof, an inner cylindrical member pivotally connected at one end to said beam and having a circular clamping head on the outer end thereof including annular jaws disposed in opposing relationship to said jaws on said tubular member.

17. The stringing apparatus of claim 16, wherein the pivotal connection of said inner and outer members are offset from one another.

18. The stringing apparatus of claim 17, wherein said clamping jaws are adjustable with respect to one another.

19. The racket stringing apparatus of claim 15, wherein said tensioning head includes hand grip means extending upward therefrom and valve means disposed in said hand gap means for selectively disabling said fluid motor.

20. The racket stringing apparatus of claim 19, wherein said control means includes pressure regulating means disposed between said pressurized source and said motor for selectively regulating the pressure communicated to said motor, and indicator means for indicating string tension applied by said tensioning head.

21. The racket stringing apparatus of claim 20, including brake means for selectively braking the rotation of said frame support table with respect to said base member.

22. A tensioning head clamp for use in a racket stringing apparatus, comprising;

a base member, first and second elongated members pivotally connected to said base member and extending co-axially therefrom, each of said elongated members having annular clamping jaws at the outer end thereof disposed in opposed relationship to one another and said elongated members being pivoted such that pivotal movement thereof moves said jaws toward and away from one another.

23. The tensioning head clamp of claim 22, wherein said first and second elongated members comprises an outer tubular member and inner cylindrical member pivotally connected to said base member in offset relationship, and said outer tubular member having a radially extending flange defining said annular clamping jaw and said inner member having an axially extending flange means defining said annular clamping jaw.

24. The tension head clamp of claim 23, wherein said outer tubular member is pivotally connected to said base member along a pivot axis intersecting and extending transverse to the axis thereof, and said inner member pivotally connected to said base member along an axis extending transverse to and offset from the axis thereof.

25. The tension head clamp of claim 24, wherein said inner member includes a foot extending outward from the axis thereof and a connecting link pivotally connecting the outer end of said foot to said base member.

26. A string clamp for use in combination with a racket stringing apparatus, comprising:

first and second elongated bar members having means at one end defining jaws, journal means intermediate the ends thereof for journaling said bars to a cylindrical support rod, and adjustable toggle means disposed on the opposide side of said journal means from said jaws for biasing said bar members about said journal means for biasing the jaws toward a clamping position, said toggle means comprises a toggle arm pivotally connected to one of said bars, and a pair of toggle links pivotally connected to separate ones of said bar members and to each other and pivotally connected at a common pivot point to said toggle arm.

27. The string clamp of claim 26, wherein one of said toggle links is connected to said one of said bar members by an adjustable pivot point.

28. A string clamp for use in combination with a racket stringing apparatus, comprising:

first and second elongated bar members having a plurality of fingers at one end defining jaws, the fingers of one of said jaws extend beyond the fingers of the other of said jaws, journal means intermediate the ends thereof for journaling said bars to a cylindrical support rod, and toggle means disposed on the opposite side of said journal means from said jaws for biasing said bar members about said journal means for biasing the jaws toward a clamping position.

* * * * *